United States Patent [19]

Dimalanta

[11] Patent Number: 4,735,166

[45] Date of Patent: Apr. 5, 1988

[54] EMERGENCY CONTROL ATTACHMENT FOR A TROLLING MOTOR

[75] Inventor: Antonio S. Dimalanta, Springfield, Mo.

[73] Assignee: Bockman & Dimalanta, Springfield, Mo.

[21] Appl. No.: 23,728

[22] Filed: Mar. 9, 1987

[51] Int. Cl.[4] ..... B63H 21/17

[52] U.S. Cl. ..... 114/146; 440/6; 440/58; 74/480 B; 74/494

[58] Field of Search ..... 114/146, 144 R, 153; 440/6, 7, 58, 60, 900; 74/480 B, 494

[56] References Cited

U.S. PATENT DOCUMENTS 4,151,807 5/1979 Black, Jr. ..... 114/153

4,624,206 11/1986 Frye et al. ..... 114/146

*Primary Examiner*—Joseph F. Peters, Jr.

*Assistant Examiner*—Paul E. Salmon

*Attorney, Agent, or Firm*—Litman, McMahon & Brown

[57] ABSTRACT

A kit includes apparatus for converting a normally remote controlled trolling motor such that the motor can be directly hand operated. The kit includes a gear mechanism which attaches to and cooperates with a directional control shaft associated with the trolling motor. An elongate transfer shaft is pivotably attachable near a lower end thereof to the trolling motor control shaft and has an outwardly extending handle near an upper end thereof for use by an operator. The transfer shaft cooperates with the gearing mechanism to rotate the directional control shaft of the trolling motor by movement of the handle by an operator. The kit may be quickly and easily retrofitted to a trolling motor after failure of remote control for the trolling motor without a fisherman having to disassemble the trolling motor or to come to shore and remove the trolling motor from the boat to effect repairs.

14 Claims, 2 Drawing Sheets

Fig. 1.
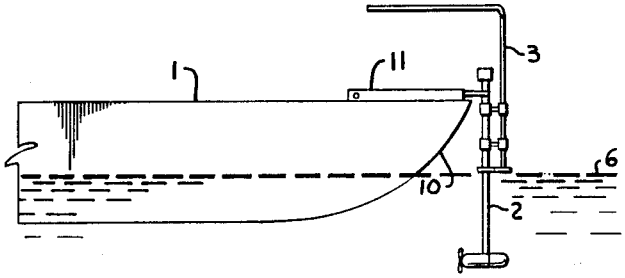
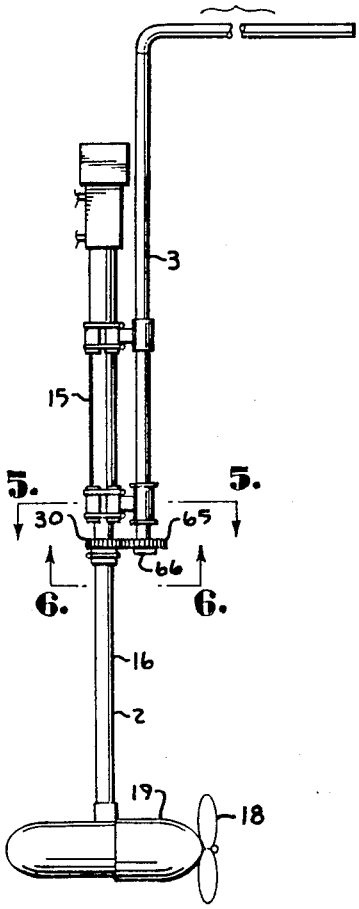
Fig. 2.
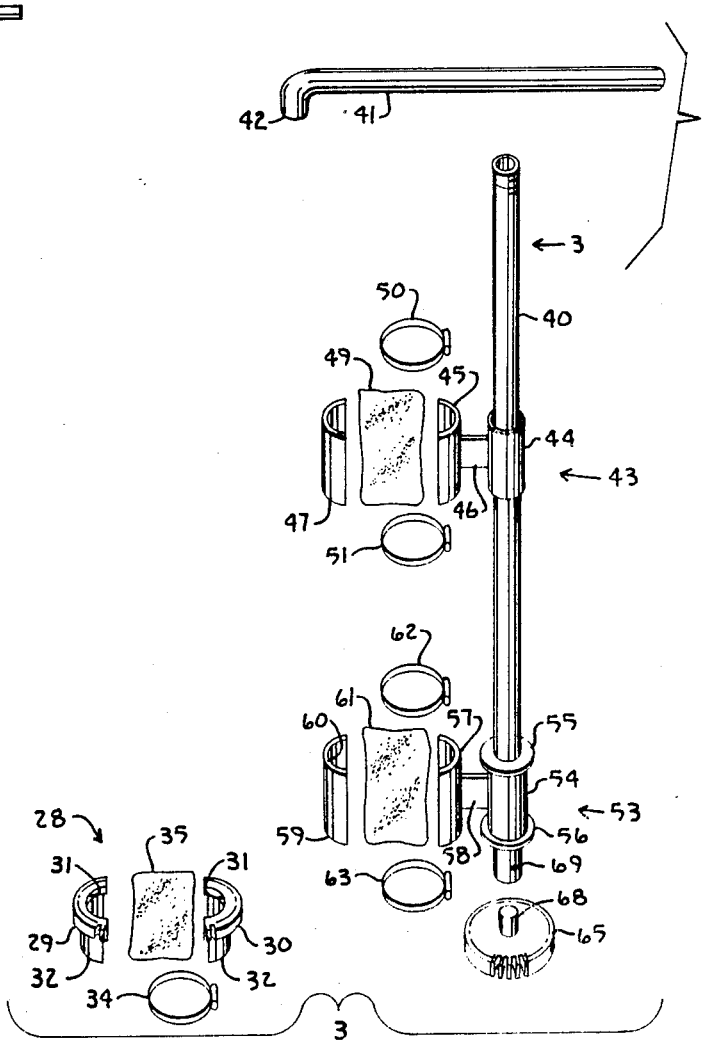
Fig. 3.

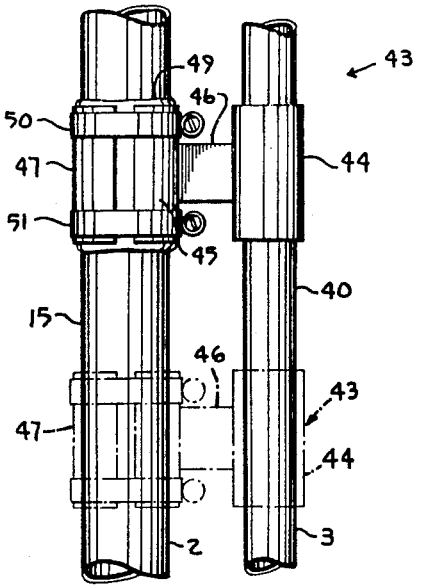
Fig. 4.
Fig. 5.
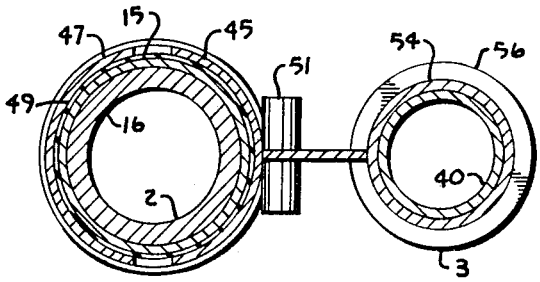
Fig. 6.
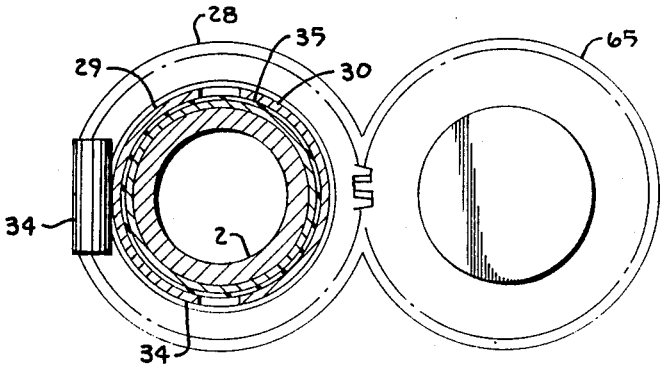
Fig. 7.
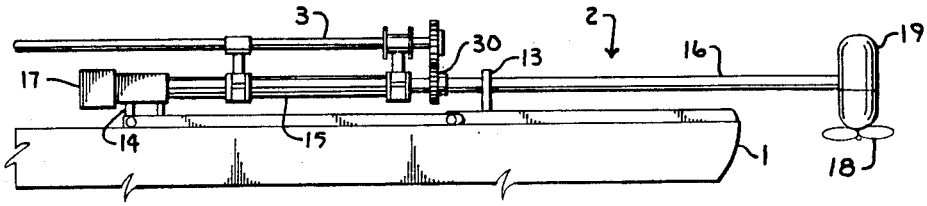

EMERGENCY CONTROL ATTACHMENT FOR A TROLLING MOTOR

BACKGROUND OF THE INVENTION

The present invention relates to an emergency control attachment for a trolling motor and, in particular, to a structure which may be quickly retrofitted to an existing trolling motor of the normally remote control type.

A trolling motor is considered by many types of fisherman to be a very important, if not critical, piece of equipment which is required to fish properly. The trolling motor is usually a small electric motor which is designed not to scare the fish, as compared to the main motor of the boat which allows the fisherman to get from shore to the area to be fished relatively quickly. The trolling motor is used to allow the fisherman to slowly traverse the area to be fished. The trolling motor is also usually mounted on a mechanism that allows it to be easily removed from the water when not in use and stored on the deck of the boat.

Because many fishermen prefer to maintain their hands free to manipulate a fishing rod, trolling motors with remote foot treadles which control direction and speed of the trolling motor have become popular. Unfortunately, the foot treadles have a high frequency of failure. Most often the failure is in the directional control of the prop. When this occurs, the fisherman has little choice but to return to shore for repairs, since most of the parts which could be controlled by a fisherman without the remote system being operational are below the level of the boat deck when the motor is operational and a fisherman cannot be very effective at fishing if he is spending most of his time leaning over the front of the boat trying to control the direction of the prop.

It is also noted that a majority of the trolling motors are of the type having a tubular sleeve fitted in one way or another to attach to the boat and having a control shaft passing through the sleeve. A first motor with a prop is attached to the bottom of the drive shaft and this motor drives the prop which provides a driving force through the water. A second motor is normally mounted to the top of the control shaft and is utilized to rotate the control shaft to place the prop in accord with the direction in which the fisherman wishes to proceed.

Since both of the motors are sealed in one way or another to prevent water from entering into and damaging or shorting them, it is desirable to not attempt to modify such a motor which does not come pre-equipped with some type of alternative control. In addition, the second or directional control motor normally has a directional arrow on the top thereof which allows the fisherman to know in which direction the prop is propelling the boat. Therefore, removal of the directional control motor may create guidance problems for the fisherman.

OBJECTS OF THE INVENTION

Therefore, the objects of the present invention are: to provide an alternative means of control for a normally remote controlled trolling motor after the normal means of control thereof has been disabled; to provide such a control mechanism which can be easily retrofitted to a conventional trolling motor, especially a trolling motor having a downwardly projecting directional control shaft with a motor and prop attached to the directional control shaft; to provide such a control mechanism which does not require disassembly of the trolling motor or cause damage to the trolling motor; to provide such a control mechanism which can be quickly retrofitted to a trolling motor while the boat upon which the trolling motor is mounted is still within the water such that a fisherman does not have to return to shore for repairs; to provide such a control mechanism including an elongate pivotable shaft which is attachable to the trolling motor and which has an outwardly projecting handle and an upper end thereof for use by an operator and an interfacing mechanism at a lower end thereof to interface with the control shaft such that an operator may rotate the control shaft by operation of the handle; to provide such a control mechanism which is storable as a kit and which may be quickly and easily assembled when needed in an emergency; to provide such a control mechanism which is relatively simple in design, easy to manufacture, and particularly well suited for the intended purpose thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a fragmentary, side elevational view of a boat having a trolling motor mounted thereon and including an emergency control mechanism in accordance with the present invention mounted on the trolling motor.

FIG. 2 is an enlarged, side elevational view of the trolling motor and control mechanism.

FIG. 3 is an enlarged and partially exploded view of the control mechanism.

FIG. 4 is an enlarged and fragmentary side elevational view of the trolling motor and control mechanism, particularly detailing the upper connecting device between the trolling motor and control mechanism and showing in phantom lines an alternative placement of the connecting device.

FIG. 5 is a enlarged cross-sectional view of the trolling motor and control mechanism, taken along line 5—5 of FIG. 2.

FIG. 6 is an enlarged and cross-sectional view of the trolling motor and control mechanism, taken along line 6—6 of FIG. 2.

FIG. 7 is a fragmentary, enlarged and side elevational view of the boat, trolling motor and control mechanism, showing the trolling motor in a stored and non-operational position.

DETAILED DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Illustrated in FIG. 1 is a portion of a conventional sport fishing boat 1, such as a bass fishing boat, upon which is mounted a conventional trolling motor 2. An emergency control attachment or mechanism, in accordance with the present invention, is generally designated by the reference numeral 3.

The trolling motor 2 is positioned on the bow or front end of the boat 1 and a mounting and lifting mechanism 11 is provided for supporting the trolling motor 2 relative to the boat 1 and to allow the fisherman to move the trolling motor from an operational position wherein the motor 2 engages water 6 into a storage position on top of the boat 1 wherein the motor 2 is out of the water 6, as is seen in FIG. 7. A rest 13 is provided on the boat to help support the motor while it is in the storage position. The trolling motor 2 is connected to the mounting and lifting mechanism 11 by pivotable connection 14.

The trolling motor 2 is of a conventional type and includes an upper, outer and generally cylindrical or tubular support shaft 15 which is generally vertically aligned when the trolling motor 2 is in the operational position, as seen in FIG. 1. Coaxially mounted within the outer support shaft 15 is a prop directional control shaft 16. The control shaft 16 is mounted so as to be rotatable relative to the support shaft 15, but not generally axially movable relative to the outer shaft 15. The control shaft 16 is approximately twice as long as the support shaft 15 and extends substantially beneath the surface of the water 6 when in operational position.

At the top of the shafts 15 and 16 is a rotational motor 17 for the control shaft 16. The illustrated motor 17 is mechanically driven and remotely controlled. Although the remote controls for the particular illustrated motor 17 are not illustrated, since they are not part of the invention, the most typical type of such controls are foot treadles which control the motor 17 which in turn rotates the shaft 16 so as to control the directional course of the boat 1, when the boat 1 is under control of the trolling motor 2. It is noted that in many of the conventional trolling motors as well as in the illustrated embodiment, the motor 17 is sealed such that easy access is not provided to the interior of the motor 17 nor to the top of the control shaft 16.

As is best seen in FIG. 2, a second motor enclosed in a housing 19 is positioned at the lower end of the control shaft 16. A prop 18 is pivotably mounted on the motor housing 19 and is operationally driven by the motor contained therein. Speed control for the motor in the housing 19 is remotely operated by means of wiring, switches and/or treadles within the boat (not shown) adapted for use by an operator. The prop 18 is located so as to rotate about an axis which is positioned at 90° relative to the control shaft 16. In this manner, as the control shaft 16 is rotated, the directional propulsion provided by the prop 18 is swung through an arc of up to 360° (a swing of 180° is shown between the position of the prop 18 in FIGS. 1 and 2). During normal operation of the trolling motor 2, a fisherman rotates the shaft 16 and consequently the motor housing 19 and prop 18 by activation of the motor 17 which provides directional control for the boat during trolling operations. The motor 17 is also remotely operated by controls (not shown) within the boat 2.

The emergency control attachment 3 includes a bifurcated gear 28 having a first segment or section 29 and a second segment or section 30. The sections 29 and 30 are designed to cooperatively fit around the shaft 16 in a coaxial relationship. In particular, when the sections 29 and 30 are properly mated together to form the gear 28, there is an interior bore 31 which is positionable in surrounding relationship to the shaft 16 and a depending sleeve 32 which extends downwardly from the remaining portion of the gear 28. The upper portion of the gear 28 has teeth whereas the sleeve 32 does not. When positioned on the shaft 16, a pad 35 is positioned between the sections 29 and 30 and the shaft 16. The pad 35 may be made of rubber or similar material which functions to provide both friction between the gear 28 and the shaft 16 and prevents damage to the shaft 16. The gear sections 29 and 30 are retained upon the shaft 16 by a clamp 34, the illustrated clamp 34 being of the hose clamp type which, when loose, wrap around the shaft 16 and over the gear sections. The clamp 34 is operated by utilizing a screwdriver to tighten and loosen.

The emergency control attachment further includes a main vertical elongate shaft 40. The shaft 40 is tubular in nature and has a relatively smooth and constant diameter exterior surface. A handle 41 is threadably attachable at one end 42 thereof to the top of the shaft 40.

Slidably positioned along the shaft 40 is a first attachment means which in the illustrated embodiment is first support 43. The first support 43 includes a sleeve 44 which is coaxially positioned upon the shaft 40 and is slidable relative to the shaft 40 both axially and radially. A first bifurcated semi-circular connection section 45 is attached to the sleeve 44 by a lug 46. A second semi-circular section 47 cooperates with the first section 45 to allow encirclement of the trolling motor support shaft 15. A pad 49 of rubber or the like is positioned interiorly of the sections 45 and 47 and the sections 45 and 47 are fixedly securable to the support shaft 15 by a pair of clamps 50 and 51 which are circumferentially positionable around the upper and lower semi-circular exteriors of the sections 45 and 47 when they are positioned around the shaft 15. Upon tightening of the clamps 50 and 51, the first support 43 is held snugly in position relative to the support shaft 15 and the shaft 40 is consequently also held in a fixed spacing relationship with the shaft 15 but is allowed to rotate radially and also is allowed to move somewhat axially as will be described below.

A second support 53 is located near a lower end of the shaft 40. The support 53 includes a sleeve 54 which is coaxially mounted on the exterior of the shaft 40 so that the shaft 40 is able to radially rotate. However, the shaft 40 has attached thereto a pair of outwardly extending washers 55 and 56, by welding or the like, near or at opposite ends of the sleeve 54 so as to prevent substantial axial movement of the sleeve 54 relative to the shaft 40. A third section 57 is fixedly joined to the sleeve 54 by a lug 58 therebetween. A fourth section 59 cooperates with the section 57 to form a bifurcated sleeve having an inner surface 60 which is placeable in surrounding relationship to the shaft 15. A pad 61 provides friction and protection to the shaft 15 and is positioned between the sections 57 and 59. A pair of clamps 62 and 63 are slidably positionable over opposite ends of outer semi-circular surfaces of the sections 57 and 59 and the clamps 62 and 63 are tightenable so that the sections 57 and 59 are securely held to the support shaft 15. This allows the shaft 40 to rotate, but prevents the shaft 40 from moving axially parallel to the shaft 15 and cooperates with the support 43 to maintain the shaft 40 at a fixed spaced distance and direction relative to the shaft 15.

The first support 43 may be moved along the shaft 40 so as to be positionable at different locations along the shaft 5, as seen in FIG. 4, so that the attachment 3 can be effectively used with somewhat structurally different motors. The first support 43 is positioned near the upper end of the shaft 15 and, since the first support 43 is slidable relative to the main shaft 40, the second support 53 is positionable near the bottom of the shaft 15 at a desired distance from the first support 43 after the first support 43 has been connected to the shaft 15.

Located at the lower end of the main shaft 40 is a gear 65 which is mateable with the gear 28. In particular, the gear 28 and the second support 53 should be positioned on the shafts 15 and 16 respectively such that the gear 65 effectively mates with the gear 28. The gear 65 includes an axial nipple 68 which is positionable in the bottom of the main shaft 40 and fixedly held in position relative to the shaft 40 by a set screw 69 or the like. The gear 65 is designed to rotate coaxially with the main shaft 40 by means of operation of the handle 41.

In use, the various parts of the emergency control attachment 3 are typically stored as a kit within the boat 1, until such time as the kit is needed due to a failure of the conventional control mechanism for the trolling motor 2. At such time as failure occurs, the trolling motor is removed from the water, as is shown in FIG. 7 and the gear mechanism 28 with associated parts is attached to the shaft 16. The shaft 40 is attached by the first and second supports 43 and 53 to the trolling motor support shaft 15 without any disassembly of the trolling motor 2 being required. The main shaft 40 is positioned by movement of the second support 53 relative to the shaft 15 such that the gear 65 meshes with the gear 28. The handle 41 is then attached to the main shaft 40 and the trolling motor 2 is thereafter repositioned in the water, such as shown in FIG. 1. By tiller movement of the handle 41, an operator can rotate the shaft 16 and consequently the direction of propulsion of the prop 18. Upon repair of the conventional directional controls for the motor unit 17, the emergency control attachment 3 can be removed from the trolling motor 2 and again stored in the boat 1 as a kit. The use of the clamps 50, 51, 52, 53 and 34 allow the emergency control attachment 3 to be retrofitted to a conventional trolling motor without disassembly of the trolling motor 2 since each opens to pass around the shafts 15 and 16 when untightened.

It is to be understood that while certain forms of the present invention have been illustrated and described herein, it is not to be limited to the specific forms or arrangement of parts described and shown.

What is claimed and desired to be secured by Letters Patent is as follows:

1. An emergency control apparatus in combination with a fishing boat trolling motor wherein said trolling motor comprises:

(a) a control shaft normally vertically aligned when operational;

(b) a motorized prop positioned near a lower end of said control shaft;

(c) support structure for said control shaft including an outer tubular support sleeve positioned on an upper portion of said control shaft and attachment means for attachng said support sleeve to a fishing boat;

(d) motor means positioned near an upper end of said control shaft and above said support sleeve; said motor means including remote control for allowing a user in a fishing boat to axially rotate said control shaft through said remote control; said motor means being generally sealed and joined to said support sleeve such that said control shaft is unaccessible above said support sleeve except by disassembly of said motor means; and wherein said emergency control apparatus comprises:

(e) an elongate shaft;

(f) attachment means for retrofitting said elongate shaft to said trolling motor support sleeve spaced from and parallel to said control shaft; said attachment means allowing axial rotation of said elongate shaft relative to said support structure; said attachment means comprises:

(1) a pair of sleeves rotatably mounted on said elongate shaft;

(2) an upper and a lower clamping mechanism attached to each sleeve respectively and removably but securely connecting said elongate shaft to said support sleeve; each of said clamping mechanisms comprises a pair of semi-circular sections positioned about said support sleeve and a clamp secured around an outer surface of both of said sections and said support sleeve to snugly hold said sections to said support sleeve;

(3) said upper clamping mechanism is slidably movable axially along said elongate shaft; and (4) said lower clamping mechanism is non-movable along the axis of said elongate shaft;

(g) rotary drive means located near a bottom of said elongate shaft operably imparting axial rotation to said control shaft as said elongate shaft rotates; said rotary drive means comprises:

(1) a first gear positioned on a lower end of said elongate shaft and axially rotating therewith;

(2) a second gear mounted on said control shaft so as to rotate axially therewith; said second gear is bifurcated in two semicircular segments each having a gear portion and a smooth outer semicircular surface position; and (3) a clamp positioned about said gear segment outer surface portions such that when tightened said second gear is secured to said control shaft;

(h) handle means located near a top of said elongate shaft and adapted to be manipulated by a user to control axial rotation of said elongate shaft; and (i) whereby selective axial rotation of said elongate shaft by a user allows emergency control of the trolling motor control shaft and consequently the direction of propulsion of said prop.

2. An emergency control apparatus for use with a trolling motor wherein the trolling motor has an underwater motorized prop and a directional control shaft for positioning the prop, the control shaft extending above the surface of the water when in use and normally being remotely controlled, the control shaft having support structure for attachment to a boat; said emergency control apparatus comprising:

(a) an elongate shaft;

(b) attachment means for retrofitting said elongate shaft to be supported by the trolling motor support structure in closely spaced relation to said control shaft; said attachment means generally parallel aligning said elongate shaft with said control shaft and allowing axial rotation of said elongate shaft relative to the support structure; said attachment means comprising:

(c) a pair of sleeves rotatbly mounted on said elongate shaft; and (d) a clamping mechanism attached to each sleeve for removably but fixedly connecting the elongate shaft to the trolling motor support structure;

(e) rotary drive means located near a bottom of said elongate shaft and adapted for connection to and cooperation with the trolling motor control shaft to impart axial rotation to the control shaft as said elongate shaft axially rotates;

(f) handle means located near a top of said elongate shaft and adapted to be manipulated by a user to control axial rotation of said ®longate shaft;

(g) whereby selective axial rotation of said elongate shaft by a user allows emergency control of the trolling motor control shaft and consequently the direction of propulsion of the prop.

3. The apparatus according to claim 2 wherein the trolling motor support structure includes a tributary sleeve around the control shaft and each of said clamping mechanisms comprises:

(a) a semi-circular section adapted to fit about the tubular sleeve; and (b) a clamp adapted to pass around an outer surface of said section and the tubular sleeve to snugly hold said section to the tubular sleeve when tightened.

4. The apparatus according to claim 3 wherein:

(a) each of said clamping mechanisms includes a pair of semi-circular sections adapted to surround the support structure; and (b) a functional protective and frictional pad for positioning between said sections and the tubular sleeve.

5. The apparatus according to claim 2 wherein:

(a) said clamping mechanisms are upper and lower clamping mechanisms;

(b) said upper clamping mechanism is slidably movable axially along said elongate shaft; and (c) said lower clamping mechanism is axially fixed relative to said elongate shaft.

6. An emergency control kit for use with a trolling motor having a water engaging prop which is positioned for directional propulsion by rotation of a control shaft; said kit comprising:

(a) an elongate shaft;

(b) attachment means for retrofitting said elongate shaft to the trolling motor such that said elongate shaft is spaced from but not generally parallel to the control shaft; said attachment means allowing axial rotation of said elongate shaft; said attachment means comprising:

(c) a first and second sleeve rotatably mounted on said elongate shaft; said first sleeve being fixed axially on said elongate shaft and said second sleeve being slidably axially relative to said elongate shaft; and (d) a clamping mechanism attached to each sleeve for fixedly connecting said elongate shaft to the trolling motor;

(e) rotary dive means located near a bottom of said elongate shaft and adapted for connection to and cooperation with the trolling motor control shaft to impart axial rotation to the control shaft as said elongate shaft rotates; and (f) whereby selective axial rotation of said elongate shaft by a user allows emergency control of the trolling motor control shaft and consequently the direction of propulsion of the prop.

7. The apparatus according to claim 6 wherein said trolling motor includes a tubular sleeve mounted on said control shaft and each of said clamping mechanisms comprises:

(a) a semi-circular section adapted to fit about the tubular sleeve; and (b) a clamp adapted to pass around an outer surface of said section and the tubular sleeve to snugly hold said section to the tubular sleeve when tightened.

8. The apparatus according to claim 7 wherein:

(a) each of said clamping mechanisms includes a pair of semi-circular sections adapted to surround the support structure; and (b) a functional protective and frictional pad for positioning between said sections and the tubular sleeve.

9. The apparatus according to claim 8 wherein:

(a) said clamping mechanisms are upper and lower clamping mechanism;

(b) said upper clamping mechanism is slidably movable axially along said elongate shaft; and (c) said lower clamping mechanism is axially nonslidable along said elongate shaft.

10. The apparatus according to claim 9 wherein said rotary drive means comprises:

(a) a first gear positioned on a lower end of said elongate shaft and axially rotating therewith; and (b) a second gear adapted to mount on the trolling motor control shaft so as to rotate axially therewith.

11. An emergency control apparatus in combination with a fishing boat trolling motor wherein said trolling motor comprises:

(a) a control shaft normally vertically aligned when operational;

(b) a motorized prop positioned near a lower end of said control shaft;

(c) support structure for said control shaft including an outer tubular support sleeve positioned on an upper portion of said control shaft and attachment means for attaching said support sleeve to a fishing boat;

(d) motor means positioned near an upper end of said control shaft and above said support sleeve and having remote control for allowing a user in a fishing boat to axially rotate said control shaft; said motor being joined to said support sleeve such that said control shaft is inaccessible except beneath said support sleeve; and wherein said emergency control apparatus comprises:

(e) an elongate shaft;

(f) attachment means for retrofitting said elongate shaft to said trolling motor support structure spaced from a parallel to said control shaft; said attachement means allowing axial rotation of said elongate shaft relative to said supprt structure; said attachment means comprises:

(g) a pair of sleeves rotatably mounted on said elongate shaft; and (h) a clamping mechanism attached to each sleeve for removably but fixedly connecting said elongate shaft to said support sleeve;

(i) rotary drive means located near a bottom of said elongate shaft and connecting said elongate shaft with said control shaft to impart axial rotation to the control shaft as said elongate shaft axially rotates;

(j) handle means attached to said elongate shaft near a top of said elongate shaft and adapted to be manipulated by a user to control axial rotation of said elongate shaft;

(k) whereby selective axial rotation of said elongate shaft by a user allows emergency control of said trolling motor control shaft and consequently the direction of propulsion of said prop.

12. The apparatus according to claim 11 wherein each of said clamping mechanisms comprises:

(a) a semi-circular section adapted to fit about the support sleeve when said apparatus is mounted on said trolling motor; and (b) a clamp adapted to pass around an outer surface of said section and the support sleeve to snugly hold said section to the support sleeve when tightened.

13. The apparatus according to claim 12 wherein:

(a) each of said clamping mechanisms includes a pair of semi-circular sections adapted to surround the support structure; and (b) a functional protective and friction producing pad positioned between said sections and the support sleeve when said apparatus is mounted on said trolling motor.

14. The apparatus according to claim 11 wherein:

(a) said clamping mechanism are upper and lower clamping mechanism;

(b) said upper clamping mechanism is slidably movable axially along said elongate shaft; and (c) said lower clamping mechanism is non-movable along the axis of said elongate shaft.

* * * * *